United States Patent [19]

Daws

[11] 4,192,334

[45] Mar. 11, 1980

[54] COLLAPSIBLE DOME FRAME

[75] Inventor: Lee F. Daws, Kingston, Canada

[73] Assignee: Her Majesty the Queen in right of Canada, Ottawa, Canada

[21] Appl. No.: 910,853

[22] Filed: May 30, 1978

[30] Foreign Application Priority Data

Jun. 30, 1977 [CA] Canada ..... 281802

[51] Int. Cl.[2] ..... A45F 1/16

[52] U.S. Cl. ..... 135/4 R

[58] Field of Search ..... 135/1 R, 1 C, 3 R, 3 B, 135/3 E, 4 R, 4 C

[56] References Cited

U.S. PATENT DOCUMENTS

| | | | |
|---|---|---|---|
| 1,253,776 | 1/1918 | Brewer | 135/3 |
| 2,953,145 | 9/1960 | Moss | 135/4 R |
| 3,683,427 | 8/1972 | Burkholz | 135/1 |

*Primary Examiner*—Reinaldo P. Machado

*Attorney, Agent, or Firm*—Stevens, Davis, Miller & Mosher

[57] ABSTRACT

A collapsible dome-shaped frame for a tent or similar structure includes a polygonal top ring formed of alternating fixed and pivotal sections, with a foldable, arcuate leg or pole connected to each pivotal section. In the collapsed condition of the frame, the poles extend downwardly, substantially at a right angle to the plane of the top ring forming a barrel-shaped cage for carrying a tent and groundsheet. In order to open the frame, the poles and each pivotal section are rotated relative to the fixed sections of the top ring, so that the poles extend outwardly from the top ring in the same plane as such ring, and the pivotal sections are locked in the open position. The poles, which are formed of arcuate segments interconnected by self-locking hinges, are unfolded to the open position, in which they define the dome-shaped frame with the top ring.

9 Claims, 16 Drawing Figures

COLLAPSIBLE DOME FRAME

This invention relates to a dome frame and in particular to a collapsible dome tent frame.

There are presently available many collapsible tents including the one proposed in the W. C. Connick, U.S. patent application Ser. No. 822,825, filed Aug. 8, 1977 of this assignee. As mentioned in such application, some of the tents utilize a frame including either a central pole and tie-down ropes, or an external or internal frame. The frames are often formed of telescoping tubular elements. In any event, presently available tent frames suffer from a number of drawbacks including difficulty in erecting and a bulky collapsed structure. Moreover, prior art frames relying on hinges to permit folding of the frame elements are often non-streamline when erected, and often require pins or other additional elements for locking the frame in the erect position.

The object of the present invention is to avoid the abovementioned drawbacks by providing a streamline dome frame, which is relatively easy to erect, structurally simple and capable of being folded into a compact cage for storage and transportation of other components of a tent or the like such as a groundsheet and tent canopy.

Accordingly, the present invention provides a collapsible dome-shaped frame for a tent or similar structure including a circular or polygonal top ring having a plurality of pairs of sections, each pair of sections including a fixed section and a pivotal section rotatable relative to the fixed section; a pole fixedly connected to each pivotal section of the ring, the poles defining a dome-shaped frame with the ring when in the open position, each pole including a plurality of segments in end-to-end relationship; and hinge means between each adjacent pair of segments of each pole permitting movement of the segments between a folded position in which the poles define a generally barrel-shaped cage and the open position, in the open position the outer surfaces of the top ring and hinge means being substantially continuous with the outer surface of said pole segments, whereby the frame is smooth and substantially free of projections.

In this disclosure and the appended claims, the term "open" is intended to mean the position in which the frame is erect for supporting a tent or the like, and the term "closed" means the position in which the frame is folded for transportation or storage.

The invention will now be described in greater detail with reference to the accompanying drawings, which illustrate a preferred embodiment of the invention, and wherein.

Figure 1:
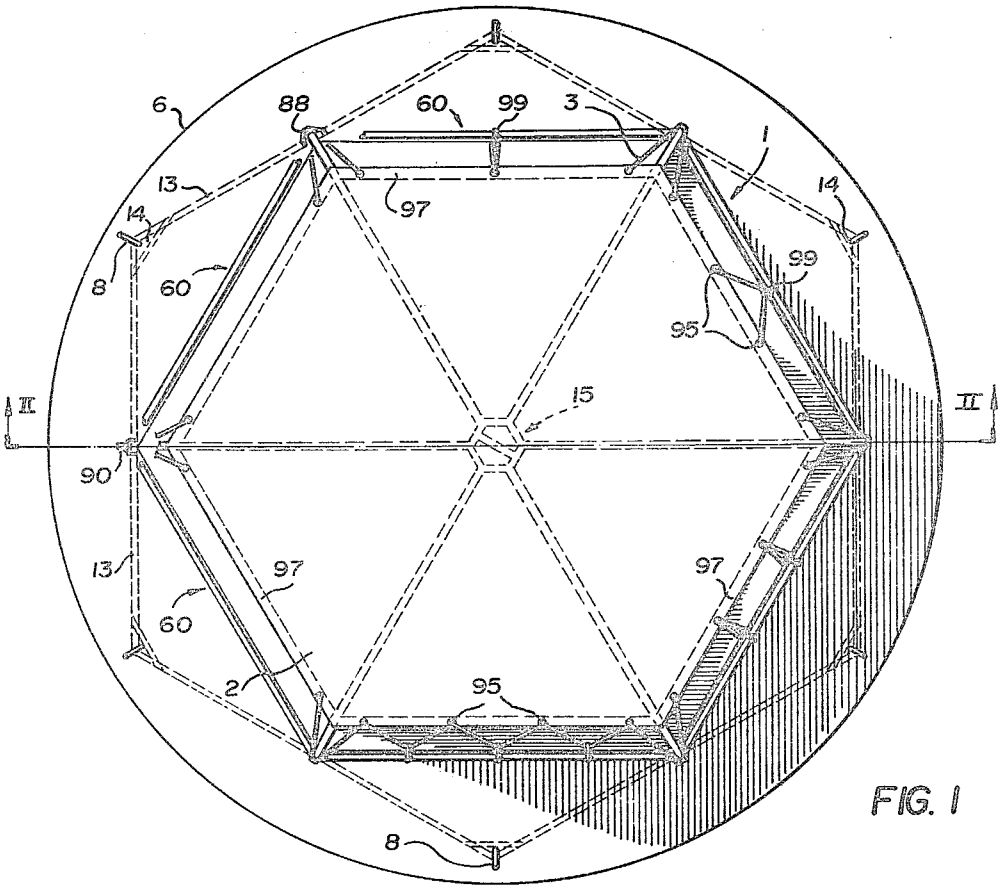
FIG. 1 is a plan view of a collapsible tent incorporating the frame of the present invention in the open position.
Figure 2:
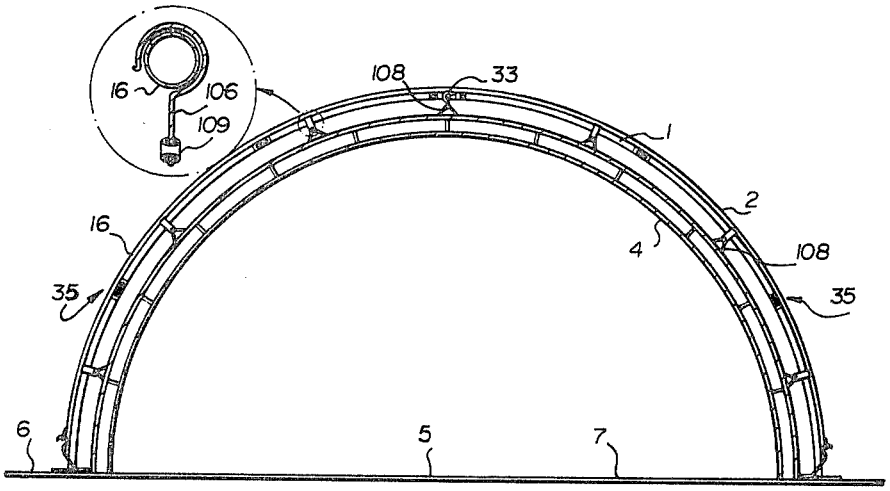
FIG. 2 is a cross-sectional view taken generally along line II—II of FIG. 1.
Figure 3:
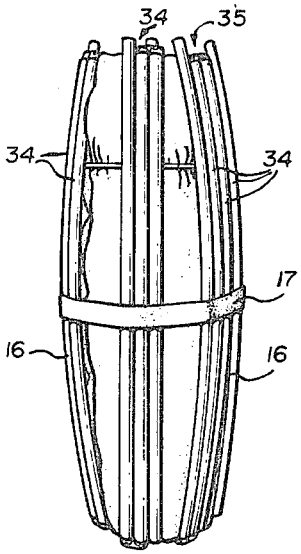
FIG. 3 is an elevation view of the tent and frame of FIGS. 1 and 2 in the closed or folded position.

With reference to FIGS. 1 to 3, a tent incorporating a frame 1 in accordance with the present invention includes an outer shell 2 mounted on the frame 1 and tied down by a rope or extensible cord 3, a double-walled inner shell 4 suspended from the frame 1 and a groundsheet 5. The groundsheet 5 is circular with a diameter larger than the greatest width of the frame 1, including a skirt portion 6 around the periphery of the frame and a floor 7 within the frame 1. The groundsheet 5 is maintained in position by pegs 8 (FIGS. 1 and 4), each of which includes a body 9 of V-shaped cross-sectional configuration tapering to a point 10 at the bottom end and a handle 11 in the form of a rod extending along and connected to the major portion of the bight of the V. The top end of the rod extends outwardly from the body 9 to an upturned outer end 12. The groundsheet 5 is provided with strips 13 of reinforcement in the form of an extra thickness of material extending in straight lines meeting at the location of peg openings 14.

Figure 4:
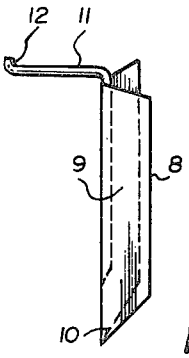
FIG. 4 is a perspective view of a peg employed in the tent of FIGS. 1 to 3.
Figure 5:
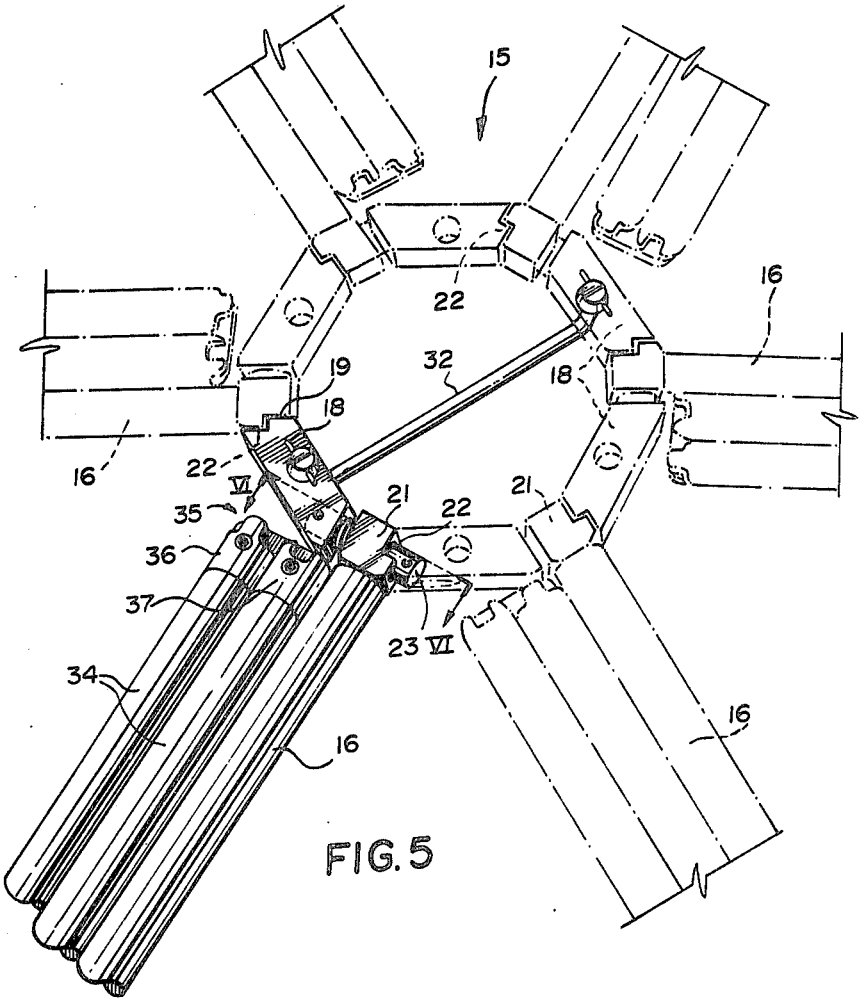
FIG. 5 is a perspective view of a top ring used in the frame of FIGS. 1 to 3.
Figure 6:
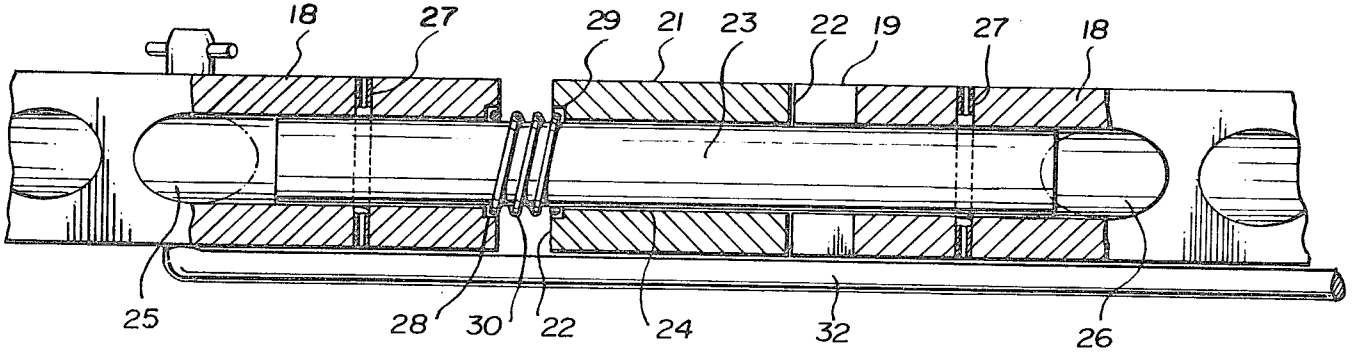
FIG. 6 is a cross-sectional view taken generally along line VI—VI of FIG. 5.

Referring now to FIGS. 4 to 6, the frame 1 includes a top ring generally indicated at 15 carrying six legs or poles 16, which are spaced equidistant apart around the periphery of the ring. In the folded or closed condition (FIG. 3) of the frame 1, the ring 15 and the poles 16 form a barrel-shaped cage for carrying the other components of the tent. A flexible band 17 is placed around the cage to maintain the frame 1 in the closed condition. The band 17 is preferably formed of elastomeric material and, during erection of the tent, is removed, the ground-sheet 5 is placed on the ground and the frame 1 is opened thereon.

The ring 15 is hexagonal, being formed of six similar pairs of sections, including a large fixed, frusto-pyramidal section 18 with one stepped end 19 and a planar end, and a smaller pivotal, rectangular parallepipedic section 21 with one stepped end 22 and a planar end. The stepped ends 19 and 22 of the large and small sections 18 and 21, respectively can be mated to lock the small sections in one position, namely the open position (FIG. 5). A rod 23 extends through each small section 21 and interconnects adjacent large sections 18; the rod extending through a longitudinal passage 24 in the small section 21 into inclined passages 25 and 26 in adjacent large sections 18. The rod 23 is locked in the large sections 18 by split pins 27. The passage 25 at the planar end of the large section 18 and the passage 24 at the planar end of the small section 21 are enlarged providing shoulders 28 and 29 between which is retained a helical spring 30 on the rod 23. One end 31 of a pole 16 is connected to each of the small sections 21.

When the frame 1 is in the closed position (FIG. 3), the spring 30 is compressed, and the opposed planar ends of adjacent large and small sections 18 and 21 are abutting. In such closed position, the small section 21 is free to rotate on the rod 23. When the pole 16 and small section 21 are rotated, the stepped ends 19 and 22 of adjacent large and small sections mate to lock the pole 16 and small section 21 in the open position (FIGS. 2, 5 and 6). In order to close the frame, it is merely necessary to move each pole 16 and the small pivotal section 21 attached thereto against the spring 30 so that the stepped ends of the large and small sections are no longer in engagement and the pole 16 can be rotated to the closed position. A generally U-shaped rod 32 extends between a pair of opposed large sections 18 for use as a handle when the frame is in the closed position (FIG. 3) and for supporting the top of the inner shell 4 of the tent which is suspended from the rod 2 by a hook 33 (FIG. 2).

As shown in FIGS. 2, 3, 5 and 7 to 9 each pole 16 is formed of three segments 34 interconnected in end-to-end relationship by a hinge generally indicated at 35, the top end (when open) of one segment being connected to a pivotal section 2 of the ring 15. The hinges 35, which are described in detail in this assignee's copending application (Ser. No. 867,836, filed Jan. 9, 1978 which description is incorporated herein by reference), are self-locking.

Each hinge 35 includes a pair of lugs 36 and 37 with reduced diameter cylindrical ends 38 and 39, respectively connected to tubular segments 34 making up the pole 16. The lug 36 is bifurcated, including a pair of arms 41 and 42 interconnected at their trailing end by a bight 44, the arms and bight defining the sides and end of a rectangular recess 45. A rectangular locking projection 46 is provided at the centre of the front end of each arm 41 and 42.

The lug 37 is also bifurcated with similar arms 48 and 49 interconnected by a bight 50, the arms and bight defining a rectangular recess 51 opposing the recess 45. Each arm 48 and 49 includes a rectangular locking groove 52 in the centre of the front end thereof for receiving one of the projections 46.

Figure 7:
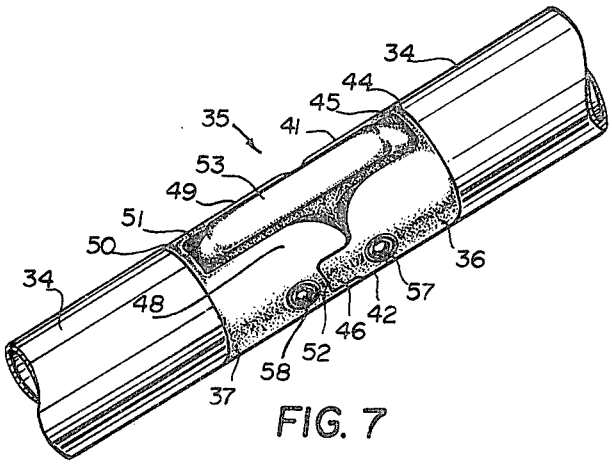
FIG. 7 is a perspective view of a hinge used in elements of the frame of FIGS. 1 to 3 in the open position.
Figure 8:
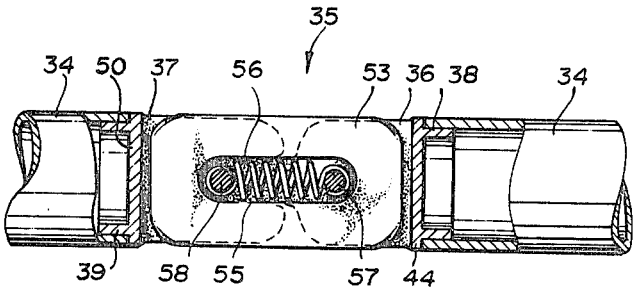
FIG. 8 is a longitudinal sectional view of the hinge of FIG. 7 in the open position.
Figure 9:
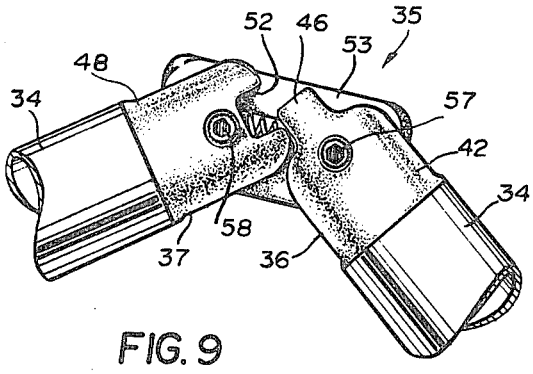
FIG. 9 is an elevation view of the hinge of FIG. 7 in the partially closed position.

The lugs 36 and 37 are interconnected by a yoke 53 extending into each of the recesses 45 and 51 between the arms 41 and 42, and the arms 48 and 49. The yoke 53 is in the form of a rectangular parallelepiped with rounded corners for facilitating closing of the hinge. A longitudinally extending slot 55 is provided in the centre of the yoke 53 for receiving a helical spring 56 and pin means in the form of set screws 57 and 58. The set screws 57 and 58 extend through the arms 41 and 42, and 48 and 49, respectively, and through the ends of the slot 55. The ends of the spring 56 are looped around the screws 57 and 58 for biasing the screws towards each other; thus pulling the lugs 36 and 37 together. Such action normally maintains the hinge in the open position (FIGS. 2, 7 and 8). When the hinge 35 is in the open position, the tent poles are in the open or erect position, i.e. unfolded from the closed position of FIG. 3.

In order to close the hinge (FIGS. 3 and 9), the lugs 36 and 37, which are normally locked in the open position by the spring 56, are pulled apart, and the lugs 36 and 37 are rotated about the axes of the screws 57 and 58. The spring 56 is stretched during closing of the hinge 35.

Figure 10:
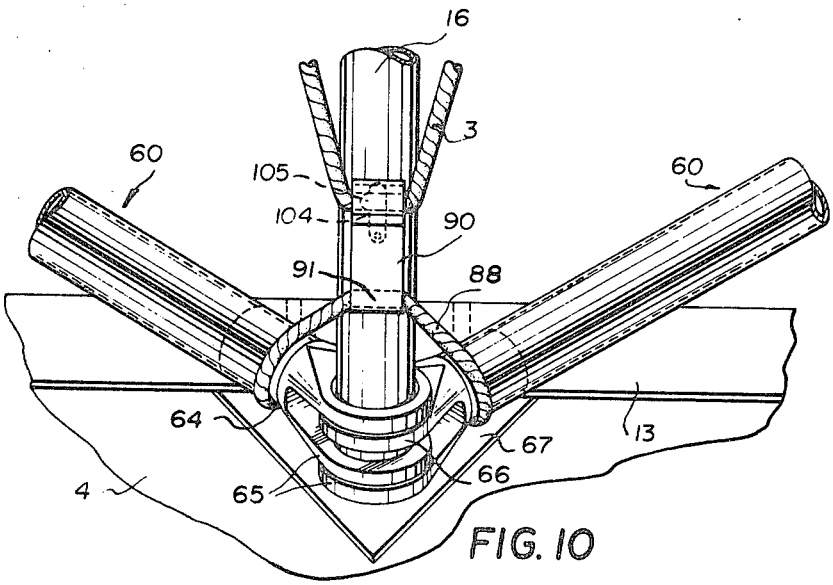
FIG. 10 is a perspective view of spacer bars and a leg tie down device used in the frame of FIGS. 1 to 3.
Figure 11:
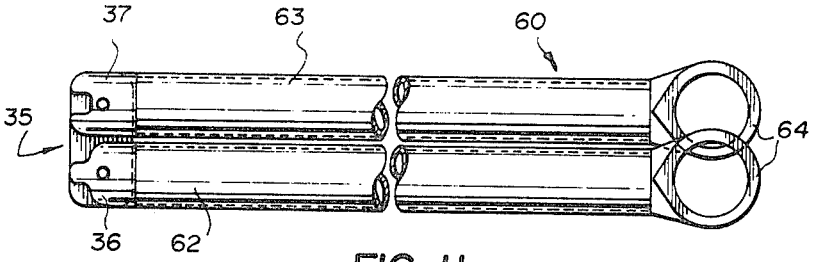
FIG. 11 is a plan view of the spacer bars of FIG. 10.
Figure 12:
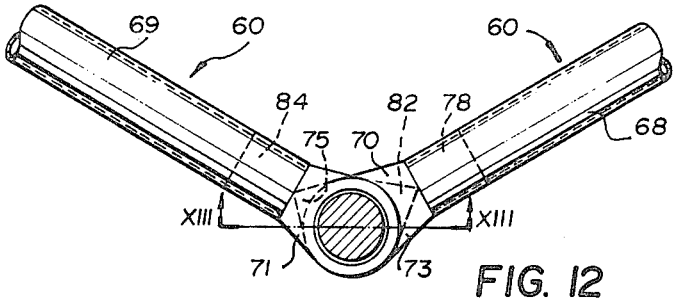
FIG. 12 is a plan view of another form of spacer bar for use in the frame of FIGS. 1 to 3.
Figure 13:
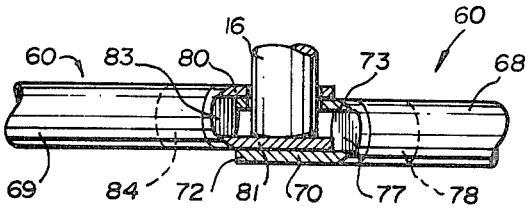
FIG. 13 is a cross-section taken generally along line XIII—XIII of FIG. 12.
Figure 14:
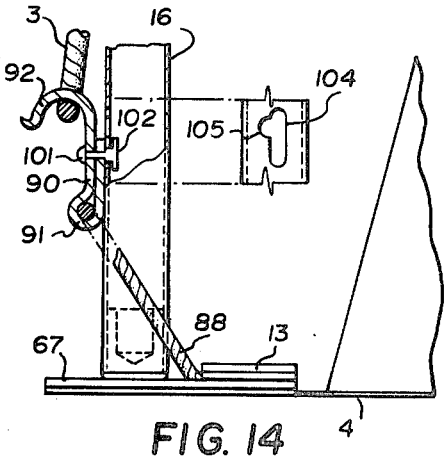
FIG. 14 is a partly sectioned side view of a leg tie down device for use in the frame of FIGS. 1 to 3.
Figure 15:
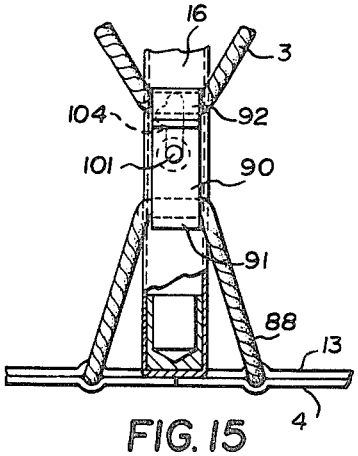
FIG. 15 is a partly sectioned end view of the device of FIG. 14.
Figure 16:
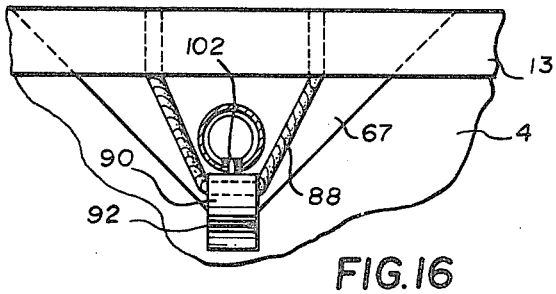
FIG. 16 is a plan view of the device of FIGS. 14 and 15.

The poles 16 once unfolded form a hemispherical or dome-shaped frame (FIGS. 1 and 2). In order to keep the poles 16 spaced apart, spacer bars generally indicated at 60 (FIGS. 1 and 10 to 13) extend between each pair of adjacent poles 16. The spacer bars 60 are in the form of tubular sections 62 and 63 interconnected by a hinge 35. The end of each section 62 and 63 opposite the hinge 35 is provided with a lug 64 having a bifurcated outer end. Such bifurcated outer end 64 includes a flat, solid bottom arm 65 on which the bottom end of a pole 16 rests and a top arm defining a ring 66. In use (FIG. 10), the pole 16 is inserted through overlapping rings 66 and extends downwardly to the overlapping bottom arms 65 of adjacent spacer bars 60. The bottom arms 65 of the lugs 64 rest on a triangular reinforcing strip 67 on the groundsheet 5.

An alternate form of spacer bar 60 (FIGS. 12 and 13) includes tubular sections 68 and 69 with lugs 70 and 71, respectively on the ends thereof. The tubular sections 68 and 69, like the sections 62 and 63, may be interconnected to similar tubular sections by a self-locking hinge 35. The lug 70 is bifurcated with a circular bottom arm 72, and a top arm 73 which is circular with a triangular locking projection 75 on one side of the outer end thereof. The inner ends of the arms 72 and 73 are interconnected by a bight with a planar front surface 77, and a small diameter portion 78 extending into the tubular section 68. The lug 71 is also bifurcated with a circular top arm 80 and a bottom arm 81 similar to the arm 73 of the lug 70, i.e. having a triangular extension 82. The arms 80 and 81 are connected by a bight with a planar front surface 83 and a small diameter portion 84 connecting the lug to the tubular section 69. In use, the vertex of each of the triangular extensions 75 and 82 bears against the planar front surface of the opposing bight to prevent movement of the tubular sections 68 and 69 beyond the desired angle at which the bottom ends of the poles 16 are properly positioned with respect to each other.

Referring now to FIGS. 10 and 14 to 16, in order to lock the poles 16 in position, a locking device is provided for use at the lower end of each pole 16. The locking device includes a length of extensible cord 88, the ends of which are sewn or otherwise secured between the reinforcement strips 13 and the groundsheet 5. The bottom end 89 of a hook 90 is permanently enclosed around the middle of the cord 88. The hook 90 is formed of a single strip of material, one end 91 of which is folded in one direction around the cord 88 and the other end 92 of which is bowed in the opposite direction for receiving the cord 3 extending around the periphery of the outer shell or cover 2 (FIGS. 1 and 2) of the tent. The cord 3 is laced through eyelets 95 in the reinforced edge 97 of the outer shell 2 and connected by C-clamps 99 to the spacer bars 60 extending between the poles 16. The centre of the hook 90 is provided with a rivet 101 having an enlarged head 102 for engaging a keyhole slot 104 in the lower end of the pole 16. The slot 104 has an enlarged portion 105 near its top end for receiving the head 102 of the rivet 101. The cord 88 is stretched to place the head 102 of the rivet 101 in the slot 104 and, when released, the hook is pulled downwardly by the cord to a locked position against the pole 16.

As will be appreciated from the foregoing in order to erect the frame 1 starting from the closed position of FIG. 3 and with the top ring 15 on the ground, the band 17 is removed and the poles 16 are partially unfolded, i.e. the top segments of the poles and the pivotal sections 21 of the top ring are rotated around the rods 23 to the open position, in which the sections 18 and 21 of the top ring 18 are locked in the open position. The groundsheet 5 and outer and inner shells 2 and 4, respectively are removed from the frame, and the groundsheet 5 is unfolded and placed in position. With the groundsheet 5 secured in position by pegs 8, two of the poles 16 can be completely unfolded and the frame moved to the erect position. The remaining poles 16 are then unfolded or opened. If spacer bars 60 are being employed, they are connected to the poles 16. The inner shell 4 of the tent is then suspended from the rod 32 of the top ring 15 and from the poles 16 using hooks 106 (FIG. 2). The hooks 106 are formed of a metal or alloy having good resiliency and low temperature qualities, e.g. a beryllium/-copper alloy. The hooks 106 are permanently connected to the top of the inner shell 4 by cords 108, which pass through a grommet 109 in the bottom end of the hooks.

It will be appreciated that the frame of the present invention, while ideally suited to tents of the type described hereinbefore can be used to support other structures, which need not be dome-shaped.

The embodiments of the invention in which an exclusive property or privilege is claimed are defined as follows:

1. A collapsible dome-shaped frame for a tent or similar structure comprising a top ring having a plurality of pairs of sections, each pair of sections including a fixed section and a pivotal section rotatable relative to the fixed section; said top ring including shaft means extending between adjacent fixed sections to permit rotation of the pivotal sections intermediate said adjacent fixed sections, said pivotal sections being longitudinally movable on said shaft means between a first position where said pivotal sections are locked open, and a second position where the pivotal sections can be rotated relative to the fixed sections; and further including locking means on one end of each pivotal section and an adjacent end of a fixed section for locking the pivotal section in the open position; a pole fixedly connected to each pivotal section of the ring; the poles defining a dome-shaped frame with the ring when in the open position, each pole including a plurality of segments in end-to-end relationship; and hinge means between each adjacent pair of segments of each pole permitting movement of the segments between a folded position in which the poles define a generally barrel-shaped cage and the open position in which the outer surfaces of said top ring and hinge means are substantially continuous with the outer surface of said pole segments, whereby the frame is smooth and substantially free of projections.

2. A frame according to claim 1 wherein said top ring includes a rod extending between two diametrically opposed fixed sections, said rod being a handle for the frame in the folded position of the frame and a support for an inner shell when the frame is in the erect position.

3. A frame according to claim 1, including a spacer bar extending between each adjacent pole when the frame is in the erect position for maintaining the poles in proper spaced apart relationship to each other.

4. A frame according to claim 3, wherein said spacer bar is collapsible.

5. A frame according to claim 3, wherein said spacer bar includes a ring on each end thereof for receiving the bottom end of one of said poles.

6. A frame according to claim 5, wherein said ring is bifurcated including upper and lower arms, each having an opening for receiving the bottom end of a pole, and a locking projection on one of said arms for engaging a similar ring on an adjacent spacer bar for preventing movement of the spacer bar and consequently movement of the pole beyond a predetermined open position.

7. A frame according to claim 3, 4 or 5, including hook means releasable mounted in the bottom end of each said pole for connecting an outer tent shell to the frame.

8. A collapsible dome-shaped frame for a tent or similar structure comprising a top ring having a plurality of pairs of sections, each pair of sections including a fixed section and a pivotal section rotatable relative to the fixed section; a pole fixedly connected to each pivotal section of the ring, the poles defining a dome-shaped frame with the ring when in the open position, each pole including a plurality of segments in end-to-end relationship; hinge means between each adjacent pair of segments of each pole permitting movement of the segments between a folded position in which the poles define a generally barrel-shaped cage and the open position in which the outer surfaces of said top ring and hinge means are substantially continuous with the outer surface of said pole segments, whereby the frame is smooth and substantially free of projections; a spacer bar extending between each adjacent pole when the frame is in the erect position for maintaining the poles in a proper spaced apart relationship to each other, each said spacer bar having a locating ring on each side thereof for receiving the bottom end of one of said poles, said locating ring being bifurcated and including upper and lower arms, each having an opening for receiving the bottom end of a pole, and a locking projection on one of said arms for engaging a similar locating ring on an adjacent spacer bar for preventing movement of the spacer bar and consequently movement of the pole beyond a predetermined open position.

9. A collapsible dome-shaped frame for a tent or similar structure comprising a top ring having a plurality of pairs of sections, each pair of sections including a fixed section and a pivotal section rotatable relative to the fixed section; said top ring including a rod extending between two diametrically opposed fixed sections, said rod being a handle for the frame in the folded position of the frame and a support for an inner shell when the frame is in the erect position; a pole fixedly connected to each pivotal section of the ring, the poles defining a dome-shaped frame with the ring when in the open position, each pole including a plurality of segments in end-to-end relationship; and hinge means between each adjacent pair of segments of each pole permitting movement of the segments between a folded position in which the poles define a generally barrel-shaped cage and the open position in which the outer surfaces of said top ring and hinge means are substantially continuous with the outer surface of said pole segments, whereby the frame is smooth and substantially free of projections.

* * * * *